US010145056B2

(12) United States Patent
Grunert

(10) Patent No.: US 10,145,056 B2
(45) Date of Patent: Dec. 4, 2018

(54) DEVICE FOR CLEANING A COMPONENT, PARTICULARLY OF A VAPORIZER OF A CONDENSER DEVICE AND A WASHER OR WASHER/DRYER COMPRISING SUCH A DEVICE

(75) Inventor: Klaus Grunert, Berlin (DE)

(73) Assignee: BSH Hausgeräte GmbH, Munich (DE)

( * ) Notice: Subject to any disclaimer, the term of this patent is extended or adjusted under 35 U.S.C. 154(b) by 779 days.

(21) Appl. No.: 12/532,203

(22) PCT Filed: Mar. 5, 2008

(86) PCT No.: PCT/EP2008/052661

§ 371 (c)(1),
(2), (4) Date: Sep. 21, 2009

(87) PCT Pub. No.: WO2008/119611

PCT Pub. Date: Oct. 9, 2008

(65) Prior Publication Data

US 2010/0101606 A1 Apr. 29, 2010

(30) Foreign Application Priority Data

Apr. 3, 2007 (DE) ..... 10 2007 016 074

(51) Int. Cl.
*D06F 58/22* (2006.01)

(52) U.S. Cl.
CPC ..... *D06F 58/22* (2013.01)

(58) Field of Classification Search
USPC ..... 68/19.2, 20; 34/595, 596, 604
See application file for complete search history.

(56) References Cited

U.S. PATENT DOCUMENTS

| | | | | |
|---|---|---|---|---|
| 404,192 | A | | 5/1889 | Haas |
| 1,526,101 | A | | 2/1925 | Sund |
| 1,626,969 | A | * | 5/1927 | Reeves ..... 137/383 |
| 2,578,994 | A | | 12/1951 | Dunaway |
| 2,742,708 | A | | 4/1956 | McCormick |
| 2,771,228 | A | | 11/1956 | Dobbie et al. |
| 2,843,943 | A | | 7/1958 | Geldhof et al. |
| 3,072,129 | A | | 1/1963 | Seal |
| 3,083,557 | A | | 4/1963 | Decatur |
| 3,103,112 | A | | 9/1963 | Behrens et al. |

(Continued)

FOREIGN PATENT DOCUMENTS

| | | |
|---|---|---|
| CN | 1609326 | 4/2005 |
| CN | 1873084 | 12/2006 |

(Continued)

OTHER PUBLICATIONS

Machine Translation of Sdrojewski, DE 102005014842, May 2006.*

(Continued)

*Primary Examiner* — David G Cormier
(74) *Attorney, Agent, or Firm* — Nixon & Vanderhye, P.C.

(57) ABSTRACT

A rinsing container is provided for use in a process air circuit of a washer or washer/dryer and receives condensation water from a condensation water tank that collects condensation water acquired in the process air circuit from the drying of wet laundry. The rinsing container is provided above the condenser and dispenses a gush of water to a selected component via the sudden opening of the rinsing container on its outlet side.

11 Claims, 2 Drawing Sheets

(56) References Cited

U.S. PATENT DOCUMENTS

| | | | |
|---|---|---|---|
| 3,572,553 | A | 3/1971 | Ogden |
| 3,650,281 | A | 3/1972 | Hurst |
| 3,709,732 | A | 1/1973 | Thomen |
| 3,910,499 | A | 10/1975 | Trouilhet |
| 4,069,521 | A | 1/1978 | Aleman |
| 4,345,343 | A | 8/1982 | Shipman |
| 4,635,824 | A | 1/1987 | Gaunt et al. |
| 4,653,200 | A | 3/1987 | Werner |
| 4,678,892 | A | 7/1987 | Finger |
| 4,700,492 | A | 10/1987 | Werner et al. |
| 4,743,933 | A | 5/1988 | Rentschler |
| 4,891,892 | A | 1/1990 | Narang |
| 5,050,259 | A | 1/1991 | Tsubaki et al. |
| 5,104,165 | A | 4/1992 | Anderson et al. |
| 5,148,768 | A | 9/1992 | Hinton |
| 5,152,159 | A | 10/1992 | Kabeya |
| 5,226,203 | A | 7/1993 | Sacconato et al. |
| 5,272,781 | A | 12/1993 | Bastin et al. |
| 5,345,947 | A | 9/1994 | Cooper et al. |
| 5,505,593 | A | 4/1996 | Hartley et al. |
| 5,706,588 | A | 1/1998 | Dausch et al. |
| 5,719,553 | A | 2/1998 | Lamparter |
| 6,042,028 | A | 3/2000 | Xu |
| 6,308,760 | B1 | 10/2001 | Finzo et al. |
| 7,213,349 | B1 | 5/2007 | Brunner |
| 7,412,853 | B2 | 8/2008 | Hong et al. |
| 8,266,814 | B2 | 9/2012 | Grunert et al. |
| 2002/0145008 | A1 | 10/2002 | Jones et al. |
| 2003/0029705 | A1 | 2/2003 | Qiu et al. |
| 2004/0162149 | A1 | 8/2004 | Bayer et al. |
| 2005/0066538 | A1 | 3/2005 | Goldberg et al. |
| 2005/0132593 | A1 | 6/2005 | Doh et al. |
| 2006/0125284 | A1 | 6/2006 | Kristi |
| 2006/0145793 | A1 | 7/2006 | Ning et al. |
| 2006/0151054 | A1 | 7/2006 | Deaton |
| 2006/0159519 | A1 | 7/2006 | Schluter et al. |
| 2006/0179676 | A1 | 8/2006 | Goldberg et al. |
| 2006/0272359 | A1 | 12/2006 | Kang |
| 2007/0113327 | A1 | 5/2007 | Denkewicz, Jr. et al. |
| 2008/0068772 | A1 | 3/2008 | Kubo et al. |
| 2009/0320312 | A1 | 12/2009 | Azpilicueta |
| 2010/0065087 | A1 | 3/2010 | Grunert |
| 2010/0101606 | A1 | 4/2010 | Grunert |
| 2010/0212369 | A1 | 8/2010 | Grunert et al. |
| 2010/0243002 | A1 | 9/2010 | Grunert et al. |
| 2010/0257669 | A1 | 10/2010 | Kennedy et al. |
| 2011/0114135 | A1 | 5/2011 | Baurmann et al. |
| 2011/0302967 | A1 | 12/2011 | Grunert et al. |

FOREIGN PATENT DOCUMENTS

| | | | |
|---|---|---|---|
| CN | 101307557 | | 11/2008 |
| DE | 2256404 | B1 | 7/1973 |
| DE | 2702639 | | 7/1978 |
| DE | 2933513 | A1 | 3/1981 |
| DE | 3321245 | | 12/1984 |
| DE | 3738031 | A1 | 5/1989 |
| DE | 4035225 | | 5/1992 |
| DE | 4212965 | A1 | 10/1993 |
| DE | 4303655 | | 8/1994 |
| DE | 4333901 | | 2/1995 |
| DE | 19600489 | | 7/1996 |
| DE | 19511344 | | 10/1996 |
| DE | 19639331 | | 3/1998 |
| DE | 19701225 | A1 | 7/1998 |
| DE | 19943125 | A1 | 11/2000 |
| DE | 10002742 | | 6/2001 |
| DE | 10002743 | | 8/2001 |
| DE | 102005014842 | | 5/2006 |
| DE | 102006006080 | | 8/2007 |
| DE | 102006018469 | | 10/2007 |
| DE | 102007016074 | A1 | 10/2008 |
| EP | 0430664 | A1 | 6/1991 |
| EP | 0468573 | A1 | 1/1992 |
| EP | 0548386 | | 6/1993 |
| EP | 0731203 | A1 | 9/1996 |
| EP | 0731204 | | 9/1996 |
| EP | 0740012 | A1 | 10/1996 |
| EP | 0816549 | | 1/1998 |
| EP | 1055767 | A1 | 11/2000 |
| EP | 1098028 | | 7/2004 |
| EP | 1936022 | | 6/2008 |
| FR | 2664625 | | 1/1992 |
| FR | 2711153 | A1 | 4/1995 |
| GB | 2115127 | A1 | 9/1983 |
| KR | 2002031581 | A | 5/2002 |
| WO | WO 2007062905 | | 6/2007 |
| WO | 2008/067352 | | 6/2008 |
| WO | WO 2008119611 | | 10/2008 |
| WO | WO 2009/095312 | | 8/2009 |

OTHER PUBLICATIONS

National Search Report CN 201080011890.6.

International Search Report PCT/EP2010/052082.

National Search Report DE 10 2009 001 548.

Non-Final Office Action issued in related U.S. Appl. No. 13/203,262 dated Aug. 21, 2014, 13 pages.

Non-Final Office Action issued in related U.S. Appl. No. 13/002,787 dated Sep. 2, 2014, 33 pages.

English Translation of the First Office Action and Search Report for Chinese Application No. 201080014638.8, 3 pages, dated Nov. 2, 2012.

English Translation of the Third Office Action and Search Report for Chinese Application No. 201080014638.8, 4 pages, dated Oct. 8, 2013.

National Search Report DE 10 2009 002 076.4, dated Apr. 1, 2009, English Translation.

International Search Report PCT/EP2010/053258, dated Aug. 10, 2010, English translation.

Final Office Action issued in U.S. Appl. No. 12/682,283, dated Jun. 9, 2014, 27 pages.

Office Action in U.S. Appl. No. 13/002,787 dated Dec. 16, 2014 (24 pages).

Office Action in U.S. Appl. No. 12/682,283 dated Jan. 14, 2015 (27 pages).

Office Action issued in U.S. Appl. No. 13/256,474 dated Mar. 5, 2015 (20 pages).

Report of Eurasian Report of Examination issued in Application No. 201070558 dated Jan. 23, 2013, 2 pages.

Roemheld, "Quick Disconnect Coupling" www.roemheld.com, issue 11 08 E, 1 page.

Roemheld, "Betriebsanlietung Schnellverschlusskupplungen" www.roemheld.com , Jan. 2004, 2 pages.

Non-Final Office Action issued in related U.S. Appl. No. 12/682,283, dated Sep. 26, 2014, 29 pages.

Office Action issued in U.S. Appl. No. 13/002,787, dated Sep. 4, 2015 (30 pages), including PTO-892 citing Murray, U.S. Pat. No. 3,268,202, issued Aug. 23, 1966.

U.S. Office Action (Notice of Allowance and Notice of Allowability) issued U.S. Appl. No. 12/682,283, dated Mar. 29, 2016 (27 pages), (including PTO-892 citing Heagerty, U.S. Pat. No. 2,660,396, issued Nov. 24, 1953; Behrens, U.S. Pat. No. 3,162,032, issued Dec. 22, 1964; Goto, U.S. Pat. No. 3,768,514, issued Oct. 30, 1973; Rigby et al., U.S. Pat. No. 5,193,562, issued Mar. 16, 1993).

Office Action (Final) issued in U.S. Appl. No. 13/002,787, dated Feb. 22, 2016 (24 pages).

National Search Report CN 201080011890.6, dated Jan. 25, 2013 (1 page).

International Search Report PCT/EP2010/052082, dated Sep. 16, 2010 (3 pages).

National Search Report DE 10 2009 001 548, dated Jan. 26, 2010 (3 pages).

Office Action (Examiner's Answer to Appeal Brief) issued in U.S. Appl. No. 13/256,474, dated Nov. 19, 2015 (25 pages).

(56) References Cited

OTHER PUBLICATIONS

Office Action (Non-Final) issued in U.S. Appl. No. 12/682,283, dated Nov. 10, 2015 (51 pages).

* cited by examiner

DEVICE FOR CLEANING A COMPONENT, PARTICULARLY OF A VAPORIZER OF A CONDENSER DEVICE AND A WASHER OR WASHER/DRYER COMPRISING SUCH A DEVICE

This application is a U.S. National Phase of International Patent Application No. PCT/EP2008/052661, filed Mar. 5, 2008, which designates the U.S. and claims priority to German Patent Application No. DE 10 2007 016 074.9, filed Apr. 3, 2007, the entire contents of each of which are hereby incorporated by reference.

BACKGROUND OF THE INVENTION

The invention relates to a method and device for cleaning a component arranged within a process air circuit of a washer/dryer, or tumble dryer, particularly an evaporator of a condenser device, by means of condensation water acquired in the process air circuit from the drying of wet laundry and collected in a condensation water tank, from which it is directed to a rinsing container provided above the evaporator and is dispensed from its outlet side onto the evaporator concerned. The invention further relates to a washer/dryer or tumble dryer with a device of the above type. It should pointed out here that a washer/dryer is understood to be a combination unit which has a washing function for washing laundry and a drying function for drying wet laundry. A tumble dryer on the other hand only has a drying function for drying wet laundry.

A method and a device of the above type for removal of lint from a condensation water separator embodied as a heat exchanger are already known (DE 37 38 031 C2). In the relevant known method and with the device provided for carrying it out, a relatively small amount of around half a liter of condensation water is used for one-off rinsing of the plates of the condenser device provided. The rinsing process concerned lasts about 30 seconds in this method. To remove lint effectively from the condenser device which has remained suspended in the condenser device concerned during the drying of wet laundry, a relatively strong rinsing of the condenser device is necessary. However this demands the use of a relatively powerful pump which pumps the condensation water out of the condensation water tank to the available rinsing device. However there is sometimes the desire to avoid this type of high outlay and to make do with a more simple arrangement in order to clean a component arranged within a process air circuit of a washer/dryer or tumble dryer, especially an evaporator of a condenser device, by means of the condensation water collected in a condensation water tank.

A device for cleaning the evaporator of a condenser device in a tumble dryer is also known (EP 0 468 573 A1). With this known device the evaporator of the condenser device consisting of a plurality of fins arranged in parallel with each other can be cleaned on its side opposite a condensation water tank by means of a cleaning device. This cleaning device consists of a brush or an arrangement of bristles able to be moved backwards and forwards to which condensation water additionally contained in the condensation water tank is fed. With this known device however the cleaning of the evaporator of the condenser device is relatively bad since the comb-shaped cleaning device is only in a position to clean the upper area of the evaporator of the condenser device, not the significantly larger area lying below it. This might possibly be able to be cleaned by the comb-type cleaning device being provided with bristles which extend over the entire depth of the evaporator. However, provided this were able to function at all, it would demand a relatively high energy outlay and thereby a relatively high constructional outlay because of the significant friction between the bristles of the comb-type cleaning device and the side walls of the fins of the evaporator. Such an outlay is however seen as undesirable.

A method and a household tumble dryer for cleaning a section of a process airflow guide are also known (DE 199 43 125 A1). In this device a fan is provided to generate the process airflow which can be brought into contact in a drying compartment with the laundry to be dried to enable it to take up moisture. Outside the drying phase in which the process airflow is created by means of the fan and is brought into contact in the drying compartment with the laundry to be dried, in a cleaning phase with the fan switched off a section of the process air guide is flooded at least partly for a specific period with a liquid. This liquid is removed again at the end of the cleaning phase from the flooded section of the process air guide. The relevant liquid especially involves condensation liquid from a condensation container in which condensation water is collected during the drying of the laundry which is obtained from drying wet laundry. To be able to undertake the said flooding of the said section of the process air guide, this is to be sealed by means of a sealing arrangement which is however currently viewed as undesirable because of the associated outlay. A more simple solution for cleaning a component arranged within a process air circuit of a washer/dryer or tumble dryer is therefore being sought.

A method for removing lint from a heat exchanger of a household appliance as well as a corresponding household appliance has already been proposed (official file reference 10 2006 061 211.6-internal file reference: 200602617), for which a rinsing liquid especially formed by a condensation created during the drying process in the household appliance is diverted as a function of the strength of a stream of air and, depending on the diversion, flows through different areas of the heat exchanger. In this case however an efficient cleaning of the heat exchanger can only be achieved with a sufficiently large volume and/or with sufficiently fast flowing rinsing liquid. How this is to be achieved however is left open in the relevant context.

BRIEF SUMMARY OF THE INVENTION

The underlying object of the invention is therefore to show a way in which in an especially simple manner a component arranged within process air circuit of a washer/dryer or tumble dryer, to wit especially an evaporator of a condenser device can be cleaned especially effectively by means of condensation water without significant outlay being required to do so.

The object illustrated here is achieved with a method of the type mentioned at the start in accordance with the invention by the condensation water being dispensed from the rinsing container by its sudden opening on the outlet side as a gush of water onto the component concerned.

The advantage of the invention is that a simple method step, namely the dispensing of the condensation water from the rinsing container as a gush of water, is sufficient to enable a component arranged within a process air circuit of a washer/dryer or tumble dryer, and especially an evaporator of a condenser device, to be cleaned effectively, and especially to clean off lint which has collected there during a drying process of wet laundry. If for example a volume of condensation water of 2.5 liters is assumed, which is collected in the rinsing container, the said efficient cleaning of the component or evaporator of the condenser device is achieved by this volume of condensation water being dispensed within a period of around 1 sec to 2 secs. In the case of dispensing 2.5 liters of condensation water within 1 sec, this corresponds to a dispensing volume of 150 liters/min of condensation water. In the case of dispensing 2.5 liters of condensation water within 2 secs taken as the example, this corresponds to a dispensing volume of 75 liters/min of condensation water. Such volumes of water—if one wanted to use a pump to dispense them—could in any event only be dispensed by a relatively large-volume and powerful pump, the use of which in washer/dryers or tumble dryers for pumping condensation water to clean components arranged there within the process air circuits, and especially evaporators of condenser devices could not be considered.

Preferably the gush of water to be dispensed onto the component is evened out between the beginning and end of being dispensed. This produces the advantage of a relatively even rinsing effect between the beginning and the end of the dispensing of the gush of water onto or into the component to be cleaned.

In accordance with a further expedient embodiment of the present invention for an evaporator of a condenser device forming the said component, the gush of water is only to be dispensed to an evaporator area located at a defined distance from the inlet area of the process air into the evaporator. The advantage of this is that increasing deposits usually occurring in the overall inlet area of the evaporator in the form of lint can be effectively removed. In this case the dispensing of the gush of water is preferably undertaken immediately after ending a drying process of wet laundry to be dried, since at this point in time contaminants, especially lint, adhering to the said component or evaporator of the condenser device are still wet and are relatively easy to remove by the rinsing liquid dispensed as a gush of water.

In accordance with another expedient development of the present invention for the evaporator of a condenser device forming the said component, the dispensing of the gush of water is undertaken by mechanically or electromechanically diverting it from a starting area provided at the inlet area of the process air into the evaporator through to an end area lying at a distance from the start area in the direction towards the outlet area of the process air from the evaporator. The advantage of this is that the component to be cleaned, and especially the evaporator of a condenser device, can be cleaned in a relatively simple manner over a definable area. The area concerned can extend in such cases from the entry area of the process air into the evaporator through to its exit area from the evaporator. The gush of water is also dispensed in this case preferably immediately after ending a drying process of wet laundry to be dried, since at this point in time contaminants, especially those adhering to the said component or evaporator of the condenser device, are still wet and can be removed well by the rinsing liquid dispensed as a gush of water.

Expediently the condensation water is pumped by means of a pump from the condensation water tank into the rinsing container. This represents a relatively simple option for providing the condensation water which is dispensed as a gush of water for cleaning the component especially formed by an evaporator of a condenser device. In such cases a relatively small pump having a low power is advantageously sufficient to pump the condensation water from the condensation water tank into the rinsing container. The power of such a pump is well below, especially orders of magnitude below, the power of a pump that has been mentioned in the context of the basic embodiment of the present invention.

Expediently the sudden opening of the rinsing container on its outlet side is controlled by actuation of bistable rinsing container closure. The advantage of this is an especially effective sudden opening of the rinsing container on its outlet side. In this case advantageous use can be made of the effect that a relatively short actuation stroke on the control side can achieve a relatively large stroke on the controlled side of an actuation element for actuating the rinsing container closure. In addition, in an advantageous manner a so-called step function imparted to the bistable rinsing container closure for the actuation of the rinsing container closure can be exploited through which a sudden movement of the rinsing container closure or opening it and also closing it is able to be carried out.

Preferably the above-mentioned actuation of the rinsing container closure is undertaken thermally or electromagnetically. This has the advantage of an especially simple actuation of the rinsing container closure.

For carrying out a method in accordance with the invention a device is preferably used with a component to be cleaned arranged within a process air circuit of a washer/dryer or tumble dryer, especially an evaporator of a condenser device, and with a condensation water tank in which condensation water arising in the process air circuit through drying of wet laundry is able to be collected, is able to be directed from said tank to a rinsing container provided above the evaporator and is able to be dispensed from this container onto the component concerned. In accordance with the invention this device is characterized in that the rinsing container has a closure part on its outlet side, through the sudden opening of which the rinsing container allows the condensation water contained within to be dispensed as a gush of water through a downpipe onto the said component.

The advantage of this is an especially low outlay for the device for cleaning a component arranged within a process air circuit of a washer/dryer or tumble dryer, and especially an evaporator of a condenser device. By the sudden opening of the rinsing container at its outlet side the condensation water collected in the rinsing container can namely be dispensed in an efficient manner rapidly as a gush of water onto the component to be cleaned, without additional devices being required for this purpose.

Expediently the said downpipe has an area which is narrowed in relation to the cross-section of the outlet area of the rinsing container. This enables a good evening-out of the dispensing of the gush of water between its beginning and its end to be achieved in a relatively simple manner.

In accordance with a further expedient embodiment of the invention, for an evaporator of a condenser device forming the said component, the gush of water is able to be dispensed to an evaporator area preferably only at a defined distance from the inlet area of the process air into the evaporator by means of a rinsing nozzle connected to the downpipe arranged at a fixed location. The advantage of this is an especially effective cleaning of the main area of the evaporator to be cleaned into which the process air enters and where it particularly deposits contaminants such as lint.

In accordance with another expedient development of the present invention the rinsing nozzle and/or the downpipe are able to be diverted during the dispensing of the gush of water by a mechanically or electromechanically-actuated diversion device from a starting area located at the inlet area of the process air into the evaporator of the condenser device to an end area at a distance therefrom in the direction of the outlet area of the process air from the evaporator. The advantage of this is that the evaporator of the condenser device is to be cleaned by the said gush of water over a definable length, which can especially be its entire length over which the process air flows through it.

Expediently the rinsing container is connected to the condensation water tank by means of a pump. The advantage of this is that the rinsing container can be filled with condensation water in a relatively simple manner.

Preferably the closure part of the rinsing container is connected to a bistable spring arrangement which is able to be actuated to open the outlet area of the rinsing container closed off by the closure part. The advantage of this is that the closure part of the rinsing container can be opened especially securely by the bistable effect of the spring arrangement. The relevant opening can in this case be undertaken especially quickly by the relevant bistable spring arrangement being given a step function to switch over into its respective bistable position.

For the previously mentioned actuation of the bistable spring arrangement a thermal or magnetic relay coupled by means of this is preferably provided. This has the advantage of an especially low effort being adequate for controlling the bistable spring arrangement.

BRIEF DESCRIPTION OF THE DRAWINGS

The present invention will be explained in greater detail by examples which refer to drawings.

The figures in the drawings are as follows.

DETAILED DESCRIPTION OF EXEMPLARY EMBODIMENTS OF THE PRESENT INVENTION

Figure 1:
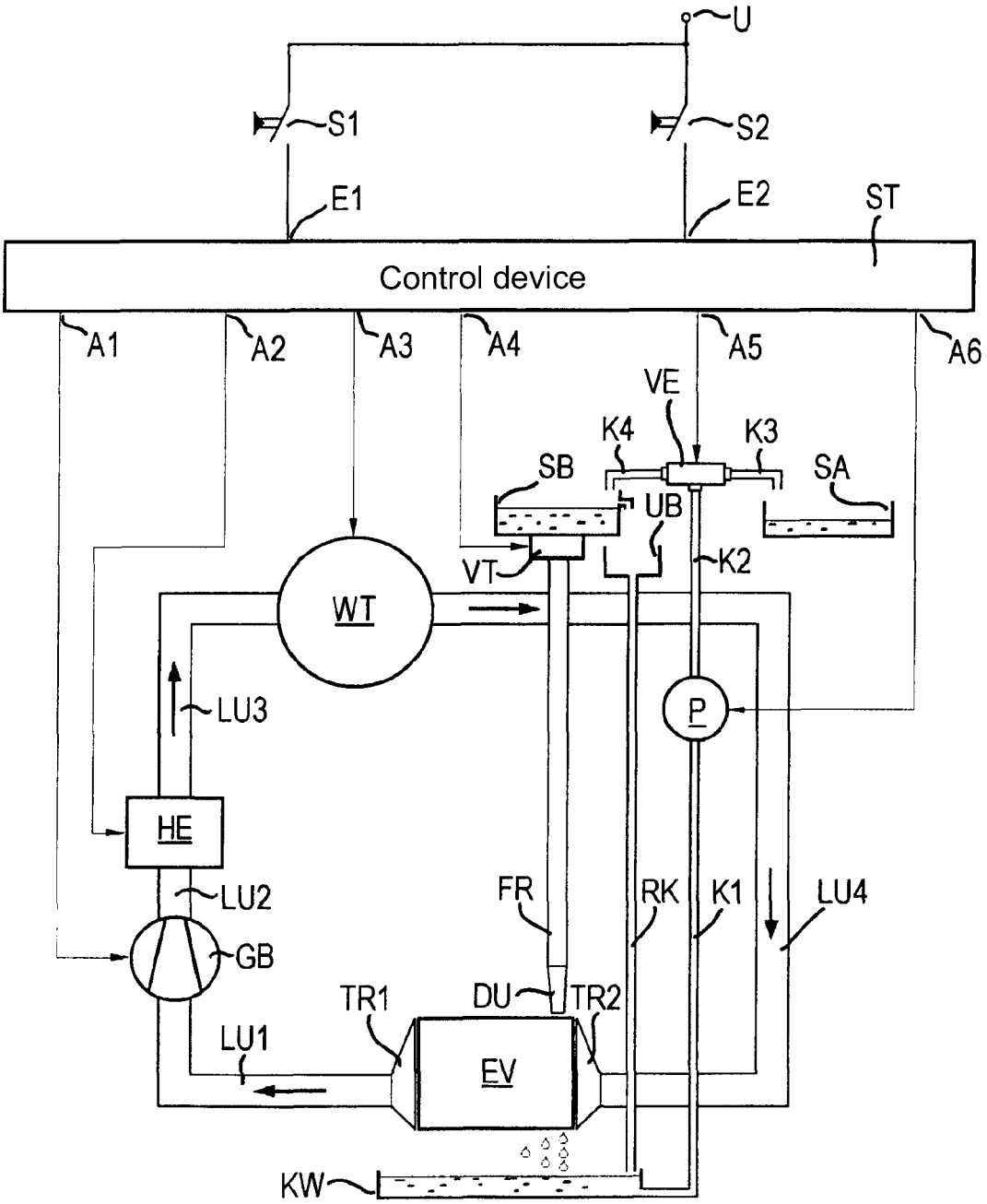
FIG. 1 a schematic diagram of a device in accordance with one embodiment of the present invention, FIG. 2 in an enlarged diagram and partly in cross-section, a rinsing container containing condensation water provided for the device in accordance with FIG. 1 with an actuation device for dispensing the condensation water located in the rinsing container as a gush of water, FIG. 3 a schematic diagram of an overhead view of an evaporator of a condenser device as is provided in the device depicted in FIG. 1, and FIG. 4 an arrangement through which the condensation water dispensed suddenly from the rinsing container in the device depicted in FIG. 1 as a gush of water is able to be dispensed over a definable area of the evaporator of the condenser device.

The device shown in FIG. 1 in a schematic diagram in accordance with an embodiment of the present invention is contained in a washer/dryer or a tumble dryer of which the parts shown in FIG. 1 are only those which are of significance for understanding the present invention. These parts include above all a washer/dryer or tumble dryer drum WT containing wet laundry to be dried and a process air flow arrangement connected to said drum examined below in greater detail, through which process air flows in a direction indicated by the arrows in FIG. 1.

The process airflow arrangement comprises a series of process air ducts LU1, LU2, LU3 and LU4 as well as devices connected to these, namely a fan GB, a heating device HE and an evaporator EV of a condenser device not shown in any greater detail in this figure. The evaporator EV in this case is connected on its outlet side via a funnel-shaped connection TR1 serving as a transition part to the one end of the process air duct LU1, to which cold, dry process air is supplied and which is connected by its other end to the input connection of the fan GB. This fan GB is connected on its outlet side via the process air duct LU2 to the inlet side of the heating device HE, which is connected on its outlet side by the process air duct LU3 to the inlet side of the washer/dryer or tumble dryer drum WT for the supply of what is now hot, dry process air. On the outlet side the washer/dryer or tumble dryer drum WT, for acquiring hot, wet process air which is taken away from wet laundry to be dried in it, is connected by the process air duct LU4 to a funnel-shaped connection TR2 also adjoining it, likewise serving as a transition part, to the inlet side of the evaporator EV. In this evaporator EV condensation of the moisture from the hot, wet process air supplied by the process air duct LU4 from the washer/dryer or tumble dryer drum WT takes place. The condensation water arising from this process in the evaporator EV enters, as indicated in FIG. 1, in the form of water droplets a condensation water tank KW arranged below the evaporator EV, in which it is collected.

The condensation water collected in the condensation water tank KW must now be removed from said tray so that it doesn't overflow. To this end the condensation water tank KW is connected in the present example by a connecting duct K1 to the inlet side of an electrical pump P, which can be a vane-type pump for example. On the output side the pump P is connected by a connecting duct K2 to the input side of a distributor VE, which might be a controllable two-way valve in the present example. The relevant distributor or the two-way valve VE has two outlet connections of which one is connected to a connecting duct K3 and of which the other is connected to a connecting duct K4.

The connecting duct K3 is used for dispensing condensation water dispensed by it pumped from the condensation water tank KW by means of the pump P up into a collection container SA of the upper area of the washer/dryer or tumble dryer containing the device in accordance with the invention. This collection container SA can for example involve a collection container able to be removed manually from the washer/dryer or tumble dryer in which the device described is contained, through which the condensation water pumped up into it from the condensation water tank KW can be disposed of.

The connecting duct K4 is used on the output side to dispense condensation water supplied to it by the distributor or two-way valve VE to a rinsing container SB. This rinsing container SB which is arranged in the washer/dryer or tumble dryer containing the device shown as far up as possible on its upper side and which can have the same storage capacity as the condensation water tank KW or the collection container SA, for example for accommodating 2.5 liters of condensation water, is provided for the sake of safety—as shown—with an overflow arrangement, through which the condensation water possibly overflowing out of the rinsing container SB reaches an overflow container UB which is connected by a return duct RK directly to the condensation water tank KW and is in a position to dispense condensation water arriving in it directly into the condensation water tank KW.

The rinsing container SB is connected by its outlet or exit side via a normally closed closure part VT, which is to be opened by actuation or control, to a downpipe FR. This downpipe FR having a relatively large cross section preferably has a length defining a drop of around 500 mm to 600 mm for the condensation water to be dispensed as a gush of water from the rinsing container SB. It is connected at its lower end in FIG. 1 to a permanently arranged outlet area extending over the entire width of the evaporator EV to an approximately oval shaped rinsing nozzle DU with the width of around 6 mm to 10 mm, which is arranged with the longitudinal center of its outlet area at a defined distance, amounting here to around 10 mm to 50 mm, from the inlet area of the evaporator EV for hot, wet process air lying to the right in FIG. 1. Through this arrangement of downpipe FR and rinsing nozzle DU, condensation water coming out of the rinsing container SB as a gush of water when the closure part VT is opened can be dispensed to an area of the evaporator preferably located only at the defined distance from the inlet area of the process air into the evaporator. The dimensions of the through opening of the closure part VT as well as the cross-section of the downpipe FR and of the rinsing nozzle DU are preferably selected in such cases so that the condensation water collected in the collection container SB—thus in accordance with the example assumed above around 2.5 liters of condensation water—is dispensed within a very short period of time of between one and two seconds as a gush of water onto the evaporator EV. Dispensing such a gush of water, i.e. at a speed of a least 2.5 liters in two seconds and preferably immediately after carrying out the drying process of the wet laundry which is located in the washer/dryer or tumble dryer drum WT for drying, results in an especially effective way in enabling lint and other contaminants to be rinsed away from the said process air inlet area of the evaporator EV and beyond this area which have been fed in via the process air duct LU4 and the funnel-shaped connection TR2.

In order to achieve a largely even dispensing quantity of the gush of water between the beginning and the end of it being dispensed, it has proved expedient for the downpipe to have an area to which the rinsing nozzle DU also belongs, which is narrowed in relation to the cross-section of the outlet area of the rinsing container SB. However it is to be ensured in this case that the previously specified minimum volume of condensation water per unit of time is provided for rinsing the evaporator EV.

To control the different devices shown in FIG. 1, as has been explained above, a control device ST is provided. This control device ST can typically comprise a microcontroller with its own software or a microprocessor control with a CPU, a ROM memory containing an operating program and a processing program and a random access memory RAM as well as interface circuits to which actuation signals are supplied on the input side and which allow control signals to be output on the output side to the various units of the device shown in FIG. 1.

The control device ST depicted in FIG. 1 typically features two input terminals E1 and E2 to which switches S1 or S2 are connected which are each connected to a power connection U which might carry a voltage of +5V for example. On the output side of the control device ST typically features six output terminals A1, A2, A3, A4, A5 and A6.

Output terminal A1 of the control device ST is connected to a control input of the fan GB which can be switched on or off by control signals supplied to this control input by it.

Output terminal A2 of the control device ST is connected to a corresponding control input of the heating device HE which can be switched on or off by control signals supplied to this control input by it.

Output terminal A3 of the control device ST is connected via a connection only to be understood as an effective connection to the washer/dryer or tumble dryer drum WT, which is able to be started into rotation or stopped by the control signals output via the corresponding connection. This means that the relevant control signals from the output terminal A3 of the control device ST will be output to a drive motor connected to the washer/dryer or tumble dryer drum WT.

The output terminal A4 of the control device ST is connected to an actuation input of the closure part VT, which is either closed or completely opened by control signals supplied to it from the output terminal A4 of the control device ST. It is however also possible for the closure part VT to be normally closed and only to be completely opened by a control signal output on the output connection A4 of the control device ST (e.g. in accordance with a binary signal "1").

The output terminal A5 of the control device ST is connected to a control or actuation input of the distributor or the two-way valve VE. By control signals output via this connection to the closure part or two-way valve VE the relevant closure part or two-way valve VE can dispense condensation water supplied to it by means of the pump P from the condensation water tank KW either to the connecting duct K3 or to the connecting duct K4 or can disable such dispensing to both connecting ducts K3 and K4.

The output terminal A6 of the control device ST is connected to a control input of the said pump P, which by control signals supplied to it through this connection can either be started into a pumping process or stopped.

In respect of the control device ST discussed here with its input terminals E1 and E2 and output terminals A1 through A6, it should also be pointed out that by closing the switch S1 connected to the input terminal E1 of the control device for example the normal drying operation of the wet laundry located in the washer/dryer or tumble dryer drum WT is initiated and carried out and that by closing the switch S2 connected to the input terminal E2 of the control device ST the dispensing of condensation water from the suddenly opened rinsing container SB as a gush of water onto the evaporator EV is controlled. In this case the actuation of the two switches S1 and S2 can only be undertaken such that in each case only one of the two switches S1 and S2 is able to be actuated. The switches concerned S1 and S2 can also each be formed by a pushbutton.

The provision of the condensation water in the rinsing container SB from the condensation water tank KW can preferably be undertaken during a drying operation or after its conclusion automatically or explicitly by manual intervention into the program control of the washer/dryer or tumble dryer containing the described device. In the event of such manual intervention into the program control the control device ST can be connected to a further input via a further switch (not shown) to the power terminal U. The dispensing of the gush of condensation water contained in the rinsing container onto the evaporator EV after the ending of the drying process enables lint and contaminants adhering to its fins LA to be easily rinsed away by the relatively high flow speed and the relatively large volume of condensation water. This rinsing process can if necessary be undertaken one or more times repeatedly with the relevant condensation water. To do this the condensation water collected again in the condensation water tank KW is to be pumped back up into the rinsing container SB from which it is then again dispensed onto the evaporator as a gush of water. After conclusion of the cleaning or rinsing process the condensation water collected in the condensation water tank KW is either to be drained away into an existing waste water system or pumped into the collection container SA which is then to be emptied manually.

Figure 2:
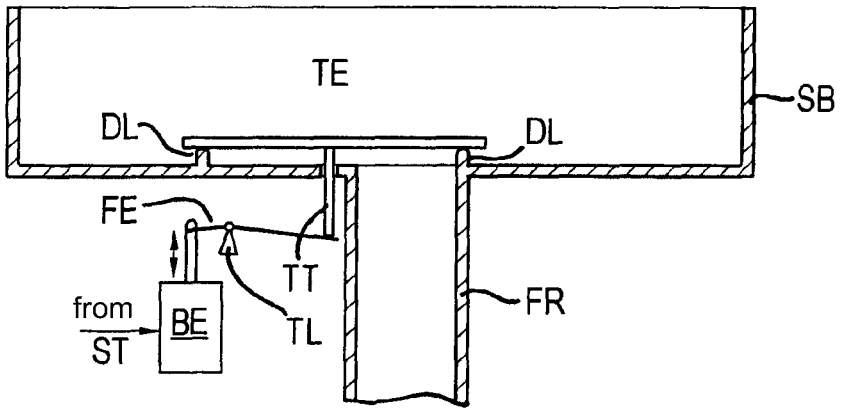

FIG. 2 depicts the schematically illustrated rinsing container SB in an enlarged cross sectional view in greater detail with its closure part. The closure part VT only depicted schematically in FIG. 1 is formed in accordance with FIG. 2 so that the rinsing container SB in the area of the downpipe FR connected to it has sealing areas or sealing lips DL, against which in the closed state of the closure part a closure plate forms a seal with its lower side. This closure plate TE has a support part TT in the central area on its lower end, which passes sealed through a base part of the rinsing container SB and which rests with its lower end on an end area of a relatively long pivot part of a bistable spring FE. This bistable spring typically formed by a leaf spring, which is preferably equipped with a step function, is supported at its support point by a static support part TL, around which the bistable spring FE concerned is in a position to be snapped over when actuated. At the end of its relative short pivot area from the support part TL the bistable spring FE is connected to a plunger of an actuation device BE. This actuation device might preferably be a thermally or electromagnetically-operating actuation device, such as a thermal relay or a magnetic relay, which is able to be controlled by the control device ST (from its output terminal A4 according to FIG. 1). The transmission ratio between the pivot areas of the bistable springs provided on both sides of the support part TL is in a position to initiate a relatively short stroke of the plunger of the actuation device in relation to a significantly larger stroke of the closure plate TE (lever principle), and preferably to do this on the basis of the bistable step function of the spring FE, so that the condensation water contained in the rinsing container can be dispensed as a gush of water through the downpipe and the rinsing nozzle to the evaporator EV according to FIG. 1.

Figure 3:
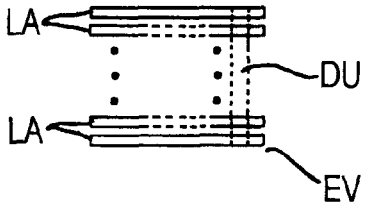

FIG. 3 shows a schematic diagram of an overhead view of an evaporator in the device shown in FIG. 1. It is evident here from FIG. 3 that the evaporator consists of fins LA running in parallel to each other. These fins are formed by metal plates which are cooled in the said condenser device so that moisture from the wet process air supplied to them from the right side in FIG. 3 is condensed on the cold surfaces of the fins LA, as illustrated in FIG. 1, for output of condensation water to the condensation water tank shown in this figure. In FIG. 3 the static position of the rinsing nozzle DU in relation to the evaporator EV is shown.

Figure 4:
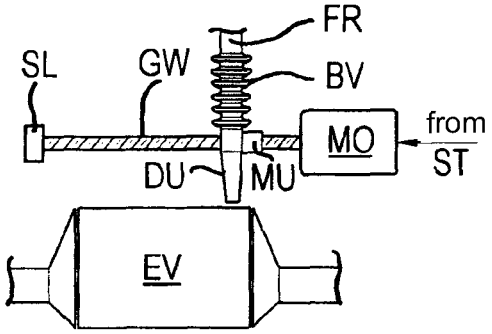

While the rinsing nozzle DU is arranged in a fixed location in relation to the evaporator EV for the evaporator shown in FIGS. 1 and 3, FIG. 4 shows a device in which the rinsing nozzle DU is able to be displaced, or more accurately deflected, in relation to the evaporator EV. In accordance with FIG. 4 a drive device is provided above the evaporator EV of the said condenser device, which consists of an electric motor able to be controlled by the control device ST, a threaded spindle GW able to be rotated by said motor and also a female connection MU coupled to this, which is connected to the rinsing nozzle DU. The threaded spindle GW, as indicated in FIG. 4, is supported at the end lying away from the motor MO by a support bearing SL.

The rinsing nozzle DU is connected in accordance with FIG. 4 to the downpipe by a movable connecting part BV, which for example can be formed by a bellows section or a corrugated hose. This displaceability of the rinsing nozzle DU in relation to the evaporator EV enables the rinsing nozzle to be deflected during the dispensing of a gush of water from a starting area located at an inlet area of the process air in the evaporator EV of the condenser device up to an end area lying at a distance therefrom in the direction of the outlet area of the process air from the evaporator EV. This means that the fins LA of the evaporator in accordance with FIG. 3 can be rinsed over a defined length, for example over their entire length, by means of the condensation water gushing out of the downpipe FR and the rinsing nozzle.

Finally it is pointed out that dispensing of a gush of condensation water explained here passing through the downpipe FR and the rinsing nozzle DU from a starting area located at the inlet area of the process air in the evaporator EV of the condenser device through to an end area lying at a distance therefrom towards the outlet area of the process air from the evaporator EV can also be undertaken by the downpipe FR being deflected accordingly together with the rinsing nozzle DU. In addition the deflection mentioned can also be illustrated in a way other than that shown in FIG. 4, i.e. generally by a mechanically or electromechnically-actuated deflection device.

LIST OF REFERENCE SYMBOLS

A1, A2, A3 Output terminals
A4, A5, A6
BE Actuation device
BV Movable connection part
DL Sealing areas or lips
DU Rinsing nozzle
E1, E2 Input terminals
EV Evaporator
FE Bistable spring
FR Downpipe
GB Fan
GW Threaded spindle
HE Heating device
K1, K2, K3, K4 Connection ducts
KW Condensation water tank
LA Fins
LU1, LU2, Process air ducts
LU3, LU4
MO Motor
MU Female connection
P Pump
RK Return duct
S1, S2 Switch
SA Collection container
SB Rinsing container
SL Support bearing
ST Control device
TE Closure plate
TL Spring support
TR1, TR2 Funnel-type connections (transition sections)
TT Support part
U Power connection
UB Overflow container
VE Distributor or two-way valve
VT Closure part
WT Washer/dryer or tumble dryer drum

The invention claimed is:

1. A washer/dryer or tumble dryer device comprising:

a process air circuit configured to circulate air in a first circulation direction to dry wet laundry; an assembly for drying wet laundry, the assembly forming a portion of the process air circuit;

a component arranged within the process air circuit, the component having an inlet area and an outlet area oriented relative to the first circulation direction;

a water tank configured to collect water; and a cleaning device for cleaning the component, the cleaning device including:

a rinsing container configured to receive the water from the water tank and a bottom of said rinsing container comprising an outlet;

a closure plate covering the outlet in a closed position; and a downpipe located above the component and below the rinsing container, the downpipe comprising a nozzle, wherein the outlet is fluidly joined with the downpipe by opening the closure plate, wherein the rinsing container is configured to dispense the water contained in the rinsing container through the downpipe onto the component by opening the closure plate at a flow rate sufficient to clean accumulated contaminants off of the component, wherein the flow rate is between 75 liters per minute and 150 liters per minute, and wherein the nozzle and the downpipe are fixed at a predetermined distance relative to the component such that the water is dispensed onto only the component at a predefined distance from the inlet area, or the nozzle and the downpipe are movable relative to the component such that all of the water is dispensed onto the component from the inlet area to the outlet area.

2. The washer/dryer or tumble dryer device as claimed in claim 1, wherein the nozzle has a cross-sectional area less than a cross-sectional area of the outlet of the rinsing container.

3. The washer/dryer or tumble dryer device as claimed in claim 1, further comprising a condenser arranged within the process air circuit, and wherein the component comprises an evaporator.

4. The washer/dryer or tumble dryer device as claimed in claim 3, wherein the evaporator has a plurality of fins, each of the fins having a length in a first horizontal direction, a height in a vertical direction, and a thickness in a second horizontal direction, the thickness being smaller than the height and smaller than the length, and wherein the downpipe is configured to guide the water over the fins in the vertical direction and into the water tank.

5. The washer/dryer or tumble dryer device as claimed in claim 1, wherein the rinsing container is configured to contain about 2.5 liters of water, and wherein the rinsing container is configured to dispense about 2.5 liters of the water contained in the rinsing container from the downpipe and onto the component.

6. The washer/dryer or tumble dryer device as claimed in claim 1, wherein the rinsing container is configured to dispense the water contained in the rinsing container from the downpipe and onto the component within a duration of about 2 seconds or less.

7. The washer/dryer or tumble dryer device as claimed in claim 6, wherein the flow rate is substantially constant during the duration.

8. The washer/dryer or tumble dryer device as claimed in claim 1, further comprising a support part extending from the closure plate, the support part extending through an opening in the bottom of said rinsing container in the closed position, and the opening being sealed.

9. The washer/dryer or tumble dryer device as claimed in claim 8, wherein the cleaning device further comprises a bistable spring configured to actuate the support part to open the closure plate.

10. The washer/dryer or tumble dryer device as claimed in claim 9, wherein the cleaning device further comprises an actuation device configured to actuate the bistable spring, wherein the bistable spring comprises a long pivot part in contact with the support part and a short pivot part in contact with the actuation device.

11. The washer/dryer or tumble dryer device as claimed in claim 10, wherein the actuation device is configured to actuate the short pivot part of the bistable spring with a step function to open the outlet.

* * * * *